US006201937B1

(12) United States Patent
Folkins

(10) Patent No.: US 6,201,937 B1
(45) Date of Patent: Mar. 13, 2001

(54) IMAGE TO PAPER REGISTRATION UTILIZING DIFFERENTIAL TRANSFER

(75) Inventor: Jeffrey J. Folkins, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/556,364

(22) Filed: Apr. 24, 2000

(51) Int. Cl.[7] ..... G03G 15/00
(52) U.S. Cl. ..... 399/49; 399/16; 399/72
(58) Field of Search ..... 399/49, 394, 16, 399/72, 15

(56) References Cited

U.S. PATENT DOCUMENTS 4,416,534 11/1983 Kluger .
4,971,304 11/1990 Lofthus ..... 271/227
5,313,252 * 5/1994 Castelli et al. ..... 399/49
5,379,128 * 1/1995 Ishida et al. ..... 399/16 X
5,404,202 * 4/1995 Abramsohn ..... 399/16
5,555,084 9/1996 Vertomile et al. .
5,652,946 * 7/1997 Scheuer et al. ..... 399/49

* cited by examiner

*Primary Examiner*—Susan S. Y. Lee
(74) *Attorney, Agent, or Firm*—L. M. Robb

(57) ABSTRACT

A method of registering a moving sheet with an image developed on a surface includes the steps of transferring at least the portion of a developed test area overlapping the sheet edge to a sheet, sensing the untransferred portion of the test area, and measuring at least one dimension of the untransferred test area to determine the image to sheet registration.

10 Claims, 2 Drawing Sheets

IMAGE TO PAPER REGISTRATION UTILIZING DIFFERENTIAL TRANSFER

BACKGROUND OF THE INVENTION

The present invention relates generally to electrostatographic reproduction machines, and more particularly to image to sheet registration in such a machine.

Generally, the process of electrostatographic production or reproduction of an image on a sheet of material is initiated by exposing a light image of an original image document onto a substantially uniformly charged photoreceptive member. The original image document may be manually placed, in registration, at an exposure station for such exposure, or it may be fed automatically by an automatic document-handling device, also in registration, to the exposure station. Exposing the light image onto the charged photoreceptive member discharges areas of a photoconductive surface thereof corresponding to non-image areas in the original document, while maintaining the charge in image areas, thereby creating an electrostatic latent image of the image of the original document on the photoreceptive member.

Thereafter, developing material including charged toner particles is deposited onto the photoreceptive member such that the charged toner particles are attracted to the image areas on the photoconductive surface to develop the electrostatic latent image into a visible image. This developed image is then transferred from the photoreceptive member, either directly or after an intermediate transfer step, to an image receiving support substrate, such as a copy sheet of paper, thus creating a toner image on the support substrate corresponding to the original image of the original document. The image receiving support substrate, such as a copy sheet of paper, typically is fed automatically from a supply source, and in timed registration, to an image transfer station for receiving the toner image as such. Subsequently, the transferred image is typically fused and affixed to the image support substrate to form a permanent image thereon. In a final step, the photoconductive surface of the photoreceptive member is cleaned to remove any residual developing material thereon in preparation for successive imaging cycles.

Sheet handling devices are commonly used in printing systems, and particularly in electrostatographic reproduction machines of the type described hereinabove, for transporting and registering document and copy substrate sheets to predetermined locations required for accomplishing the printing process. Such sheet handling devices are generally referred to in two categories: document handlers, which are used to transport image bearing sheets; and copy substrate sheet handlers, which transport blank page sheets of material for receiving toner images. Printers, duplicators and copiers commonly employ both types of sheet handling devices to transport sheets to and from an image reproduction or imaging subsystem. As pointed out above, such subsystems or stations include the exposure or image input scanning station, and the toner image transfer station. Image input devices, which include scanners, optical character readers and the like, also employ sheet handling devices of the type to which this invention relates.

In systems employing such sheet handling devices, maintaining proper alignment of the image support sheet along the transport path thereof so as to inhibit skew or misalignment of the sheet being transported is an important function required for acceptable performance. For example, it is important to deskew or inhibit skew in a transported document sheet in a typical electrostatographic reproduction machine employing an automatic document handler device. In such machines, the automatic document handler device automatically transports or feeds a document sheet from a stack thereof to a registered position at the exposure station. As such, it is important to deskew or inhibit skew in the transported document sheet so as to provide proper registration of the image on the document sheet to an imaging frame of the photoconductive member which is then at a fixed position at the exposure station.

Similarly, it is important in a copy sheet handling device of the machine, to deskew or inhibit the skew of a transported copy sheet during image transfer, in order to provide proper registration of the copy sheet to the toner image on the photoconductive member. Failure to properly control skewing and registration of input documents in a document handler, or in copy sheets being handled by a copy sheet handling device, will result in the image produced being misaligned relative to the edges of the copy sheet, and hence being of poor quality. In addition, failure to properly deskew a document or copy sheet can cause jams and other similar paper transport problems. Thus, in sheet transport devices, such as document feeders and automatic or semiautomatic document handlers, as well as in copy sheet transport devices, proper control of skew and registration of sheets being handled, are important and essential system requirements.

Adequate image to paper registration and skew performance are two attributes that are difficult to design into a printing system. Generally, high performance printers allow for offline measurement of registration and/or skew performance. This measurement is performed in the factory or at installation of a printing system at a customer site. Typically a service technician visually examines registration marks on a printed page and then makes any necessary machine adjustments. This human intervention to perform registration and/or skew measurement is both time-consuming and costly to the customer. A method that provides for machine measurement of registration and/or skew without assistance would present significant cost and reliability improvements.

The following disclosures may be relevant to various aspects of the present invention and may be briefly summarized as follows:

U.S. Pat. No. 5,555,084 to Vetromile et al. discloses an apparatus for registration of a sheet with a developed image on a moving surface. The apparatus includes a transfer station, detector, registration controller, and a registration transport. The detector, located at the transfer station, includes a pair of lead edge sensors and a side edge sensor. The lead edge sensors detect the lead edge of a sheet of paper and provide skew information to a registration controller until the side edge sensor signals the registration controller of an edge-registered condition. Until the signal from the side edge sensor is received, differential motors correct the skew by driving a pair of rolls, which move the sheet of paper to correct the paper skew.

U.S. Pat. No. 4,971,304 to Loftus discloses an edgeless sheet registration system suitable for an electrophotographic printing machine. The registration system transports a sheet to a transfer zone, wherein the edges of the sheet are synchronized with an image developed on a photoconductive belt. Sheet registration is accomplished in the process and lateral directions, as well as for skew position. The sheet velocity is also matched to the velocity of the belt. In operation, two separate motors drive the sheet non-differentially in the process direction. The sheet is driven until it reaches two optical sensors, which detect passage of selected sheet portions thereby. Signals from the sensors are communicated to a controller, wherein the time difference between passage of the selected sheet portions is used to compensate the random skew. Compensation is achieved by the controller driving the motors differentially, so as to guide the sheet into a preselected skew magnitude. The motors continue to run differentially to compensate for the induced skew until a side edge of the sheet is detected by a third sensor. Detection by the third sensor establishes registration in the lateral direction. Thereafter, the motors again run in a non-differential mode to drive the sheet in the process direction. A fourth sensor located downstream, along the path of travel, is provided to detect the time of passage of the registered sheet thereby.

U.S. Pat. No. 4,416,534 to Kluger discloses a registration method and apparatus for a variable pitch copier. Registration is accomplished through achieving a speed and position match between a copy sheet and an image on a photoconductor as the copy sheet approaches an image transfer station. The speed and position of both image and copy sheet are monitored and updated by a programmed microprocessor. Controlled accelerations and brakings of a copy sheet drive motor under microprocessor control first achieve registration and then maintain that registration as the image transfer occurs. The disclosed registration method automatically adjusts for variable spacings between successive images about the periphery of the photoconductor to accommodate various image sizes.

SUMMARY OF THE INVENTION

A method of registering a moving sheet with an image developed on a surface includes the steps of transferring at least the portion of a developed test area overlapping the sheet edge to the sheet, sensing the untransferred portion of the test area, and measuring at least one dimension of the untransferred test area to determine the image to sheet registration.

A printing machine in which a moving sheet is registered with an image developed on a surface includes a transfer station to transfer at least the portion of a developed test area overlapping the sheet edge to the sheet and a sensor to sense the untransferred portion of the test area and to measure at least one of the untransferred test areas to determine the image to sheet registration.

BRIEF DESCRIPTION OF THE DRAWINGS

The foregoing and other features of the instant invention will be apparent and easily understood from a further reading of the specification, claims, and by reference to the accompanying drawings in which:

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

Figure 1:
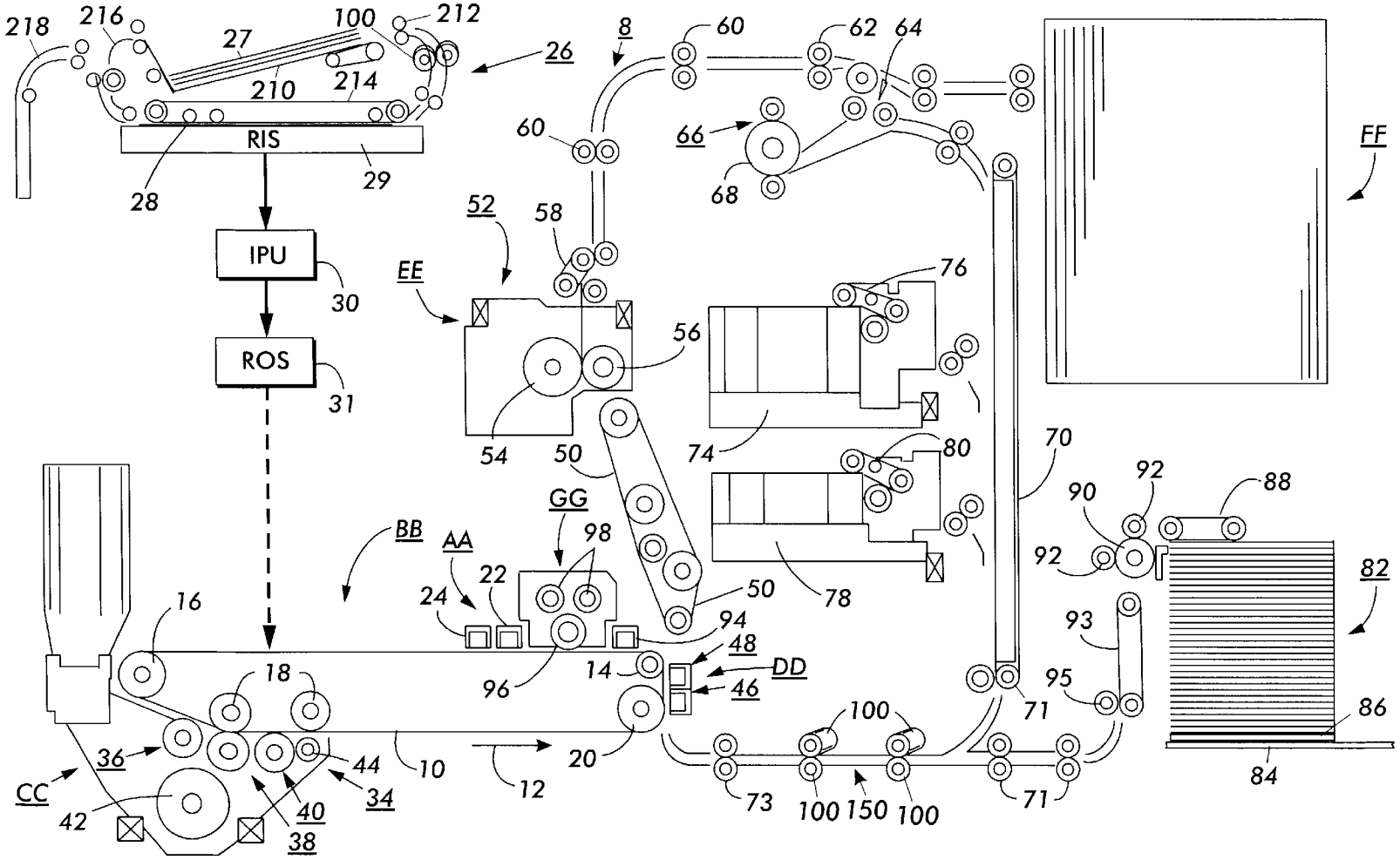
FIG. 1 is a schematic elevational view of an electrophotographic printing machine incorporating the inventive features of the present invention.

Referring initially to FIG. 1, a schematic depiction of an exemplary electrostatographic reproducing machine incorporating various machine systems is furnished in order to provide a general background and understanding of the features of the present invention. Although the apparatus of the present invention is particularly well adapted for use in an automatic electrostatographic reproduction machine 8 as shown in FIG. 1, it will become apparent from the following discussion that the image to paper registration method roll of the present invention is equally well suited for use in a wide variety of electrostatographic processing machines, and in many other known printing systems.

The exemplary electrostatographic reproduction machine 8 of FIG. 1 employs a photoconductive belt 10, preferably comprising a photoconductive material coated on a ground layer, which, in turn, is coated on an anti-curl substrate. Belt 10 is entrained about stripping roll 14, tensioning roll 16, rolls 18, and drive roll 20. Stripping roll 14 and rolls 18 are mounted rotatably so as to rotate with belt 10. Tensioning roll 16 is resiliently urged against belt 10 to maintain belt 10 under a desired tension. Drive roll 20 is rotated by a motor (not shown) coupled thereto by any suitable means such as a drive belt. Thus, as roll 20 rotates, it advances belt 10 in-the direction of arrow 12 to advance successive portions of the photoconductive surface sequentially through various electrostatographic processing stations disposed about the path of movement thereof.

Initially, a portion of photoconductive belt 10 passes through charging station AA where two corona generating devices, indicated generally by the reference numerals 22 and 24 charge a surface of the photoconductive belt 10 to a relatively high, and substantially uniform potential. This dual charging system is designed so that corona generating device 22 places all of the required charge on photoconductive belt 10 while corona generating device 24 acts as a leveling device to provide a uniform charge across the surface of the belt. Corona generating device 24 also fills in any areas missed by corona generating device 22.

Next, the charged portion of photoconductive belt 10 is advanced through imaging station BB. At imaging station BB, a document handling unit or handler, indicated generally by reference numeral 26, is positioned over platen 28 of the reproduction machine 8. The document handling unit 26 sequentially feeds documents from a stack 27 of original document sheets placed in a document stacking and holding tray 210 as shown, such that the original document sheets containing images to be copied are loaded, for example, face up in the document tray. As is well known, the document handling unit 26, although shown as a bottom feeder, can also be a top feeder. In either case, a bottom or top sheet respectively is fed seriatim from the stack to rolls 212 for advancing in registration onto platen 28 by means of a belt transport 214. As shown, the belt transport 214 is moved over the platen 28 with the original document sheet being interposed between the platen and the belt transport.

When the original document sheet is properly positioned and registered on platen 28, the document is imaged and the original document is returned to the document tray from platen 28 by either of two paths. If only a simplex copy of the document sheet image is being made or if this is the first pass of a two pass duplex copying process, the original document sheet is returned to the document tray 210 via only a simplex path 216. If the document sheet is to be imaged on a second pass of a two pass duplex copying process, then the original document sheet is instead first moved through a duplex path 218, re-imaged, and then returned to the document tray through simplex path 216.

Imaging of the document is achieved by a scanning assembly, preferably comprising a Raster Input Scanner (RIS) 29 for capturing the entire image from the input document and converting the image into a series of raster scan lines corresponding to individual picture elements or so-called pixels making up the original input document. The output signal of the RIS 29 is transmitted as an electrical signal to an Image Processing Unit (IPU) 30 where they are converted into an individual bitmap representing the receptive values of exposure for each pixel. The IPU 30 can store bitmap information for subsequent imaging or can operate in a real time mode. The digital output signal generated by the IPU 30 is transmitted to a Raster Output Scanner (ROS) 31 for writing the image bitmap information onto the charged surface of the photoreceptive belt 10 by selectively erasing charges thereon in a pixel-by-pixel manner.

It should be noted that either a discharged area development (DAD) approach in which discharged portions are developed can be employed, or a charged area development (CAD) approach in which charged areas are developed can be employed, as known in the art. This process records an electrostatic latent image on photoconductive belt 10 corresponding to the informational areas contained within the original document. Thereafter, photoconductive belt 10 advances the electrostatic latent image recorded thereon to development station CC.

At development station CC, a magnetic brush developer housing, indicated generally by the reference numeral 34, is provided, having three developer rolls, indicated generally by the reference numerals 36, 38 and 40. A paddle wheel 42 picks up developer material in the developer housing and delivers the developing material to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zone or nip about each roll.

Developer roll 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station DD.

At transfer station DD, a copy sheet (not shown) is moved in timed registration, into contact with the toner powder image on belt 10. A high capacity feeder, indicated generally by the reference numeral 82, is the primary source of copy sheets. High capacity feeder 82 includes a tray 84 supported on an elevator 86. The elevator is driven by a bi-directional motor to move the tray up or down. In the up position, the copy sheets are advanced from the tray 84 to transfer station DD, via a copy sheet handling system including a vacuum feed belt 88 that feeds successive uppermost sheets from the stack to a take away roll 90, and rolls 92. The take-away roll 90 and rolls 92 guide the sheet to a vertical transport 93. Vertical transport 93 and roll 95 advance the sheet to rolls 71 which, in tum, move the sheet through a registration assembly 150 including force reducing deskew rolls 100 of the present invention (to be described in detail below), and toward the toner image transfer station DD.

As shown, copy sheets may also be fed to transfer station DD from a secondary tray 74 or from an auxiliary tray 78, which each includes an elevator driven by a bidirectional AC motor and a control having the ability to drive the tray up or down. When the tray is in the down position, stacks of copy sheets are loaded thereon or unloaded therefrom. In the up position, successive copy sheets may be fed therefrom by a sheet feeder 76 or 80 that includes a friction retard feeder utilizing a feed belt and takeaway rolls to advance successive copy sheets to transport 70.

As previously discussed, it is important that proper alignment of the copy sheet is maintained along a transport path of the copy sheet handling system thereof so as to inhibit skew, and so as to provide proper alignment and registration of sheets transported through the transfer station. Preventing skew and proper registration are necessary for producing an output copy sheet on which the image imparted thereto is properly centered and aligned. Failure to provide proper registration of a copy sheet will generally result in unacceptable image transfer to the copy sheet. Unacceptable images include images that are not in alignment with the copy sheet edge (so-called skewed images), images extending off of the edge of the sheet, and images containing other mis-imaging problems. Failure to provide deskew and proper registration can also result in paper jams and other substrate feed failures.

Still referring to FIG. 1, at the transfer station DD, the developed or toner image on belt 10 contacts the properly registered advancing copy sheet in timed registration, and is transferred thereto. As can be seen in the illustrated embodiment, a corona generating device 46 charges the copy sheet to a proper potential so that the sheet is electrostatically secured or "tacked" to belt 10 and the toner image thereon is attracted to the copy sheet. After image transfer, a second corona generator 48 charges the copy sheet to a polarity opposite that provided by corona generator 46 for electrostatically separating or "de-tacking" the copy sheet from belt 10. Thereafter, the inherent beam strength of the copy sheet causes the sheet to separate from belt 10 onto conveyor 50, positioned to receive the copy sheet for transporting to fusing station EE.

Fusing station EE includes a fuser assembly, indicated generally by the reference numeral 52, which fuses and permanently affixes the transferred toner image to the copy sheet. Preferably, fuser assembly 52 includes a heated fuser roll 54 and a pressure roll 56 with the powder image on the copy sheet contacting fuser roll 54. The pressure roll 56 abuts the fuser roll 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a de-curling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roll pairs 60 to duplex turn roll 62. A duplex solenoid gate 64 selectively guides the copy sheet to finishing station FF or to inverter 66. In the finishing station, the copy sheets are collected in sets and the copy sheets of each set can be stapled or glued together. Alternatively, duplex solenoid gate 64 diverts the sheet into inverter 66, providing intermediate storage for one sheet which has been printed on one side and on which an image will be subsequently printed on the second, opposed side thereof, i.e. the sheet being duplexed. In order to complete duplex copying, the simplex sheet in inverter 66 is fed by a feed roll 68 from inverter 66 back to transfer station DD for transfer of the toner powder image to the opposite side of the copy sheet.

Invariably, after the copy sheet has been separated from photoconductive belt 10 subsequent to image transfer therefrom, some residual particles remain attached to the surface of the belt 10. As a result, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt in preparation for the next charging cycle. Residual particles are removed from the photoconductive surface at cleaning station GG. Cleaning station GG includes an electrically biased cleaner brush 96 and two waste and reclaim de-toning rolls 98. One reclaim roll 98 is electrically biased negatively relative to the cleaner roll 96 so as to remove toner particles therefrom while the other reclaim roll 98 is electrically biased positively relative to the cleaner roll 96 so as to remove paper debris and wrong sign toner particles. The toner particles on the reclaim roll 98 are scraped off and deposited in a reclaim auger (not shown), where they are transported out of the rear of cleaning station GG.

The various machine subsystems described hereinabove are typically regulated by an electronic subsystem (ESS) (not shown) which is preferably a control such as a programmable microprocessor capable of managing all of the machine functions. Among other things, the control provides a comparison count of the copy sheets, the number of documents being recirculated, the number of copy sheets selected by the operator, time delays, jam indications and subsystem actuation signals. Conventional sheet path sensors or switches may be utilized to keep track of the position of documents and the sheets in the machine. In addition, the control regulates the various positions of gates and switching depending upon the mode of operation selected.

The foregoing description should be sufficient for the purposes of the present application for patent to illustrate the general operation of an electrostatographic printing apparatus incorporating the features of the present invention. As previously discussed, the electrostatographic reproducing apparatus may take the form of any of several well known systems including various printing and copying machines manufactured by Xerox Corporation. Variations of specific electrostatographic processing subsystems or processes may be expected without affecting the operation of the present invention.

The ROS as discussed above performs the function of creating the output image copy on a photosensitive surface of the belt by successively scanning the belt surface with a series of modulated scan lines, each line having a certain number of pixels per inch to form the latent images, which are subsequently developed, transferred to an output sheet and fused. The process may be used in either a single pass system wherein a plurality of imagers and developing and charging stations are used or in a multiple pass system where a single imager station forms images which are developed and returned for further imaging and development. The ROS is also controlled to form latent registration images outside of as well as inside of the image frame. In a preferred embodiment, these latent images are developed and sensed. Using the ROS and the control electronics of the ESS described above, and referring to FIG. 2, a registration pattern is formed on the surface of the belt 10 moving in the direction of arrow 12. The methods described herein are applicable to any geometric form of registration mark and a variety of different photodetectors. For clarity and convenience, the schemes will be described in terms of rectangular marks and optical density sensors. The pattern is formed to overlap both the lead edge of the sheet of paper and the interdocument zone.

As defined herein, the "width" of a sheet (or a copy sheet width) for purposes of the copy sheet paper path is the length of the edge of the sheet, which is parallel to a process direction in which copy sheets are fed through the paper path. In the present embodiment, since smaller sheets such as 8½×11 inches sheets are fed with their long edge (the 11-inch edge) first, their "width" in the paper path is 8½ inches. Since large sheets such as 11×17 inch sheets are fed with their short edge (the 11-inch edge) first, their width in the paper path is 17 inches. Also, the "lead" edge of a copy sheet travels through the paper path in the process direction. Conversely, the "length" of a copy sheet is the edge of a sheet that is perpendicular to the sheet's process direction. In a system with a duplex paper path, such as the system described herein, the "lead" edge of a copy sheet which travels perpendicular to the process direction becomes the "trail" edge of the copy sheet once the sheet is inverted by duplex inverter 66.

Returning now to FIG. 2, when the sheet passes through transfer station DD, the registration image A is partially transferred to copy sheet 110, such that registration image A overlaps the lead edge or trail edge of the sheet. The remaining untransferred image is then detected by an optical density sensor of any known type and a measurement of the width s of the untransferred image is made. This measurement is provided to the ESS, which compares the measured untransferred toner width value to a known value or series of values to determine the image to paper misregistration with the lead edge of the copy sheet in the process direction. The known values may be either programmed into the ESS software initially or may be empirically programmed in as part of a system setup adjustment. Although this approach is utilized for the best mode of the invention as disclosed herein, there are many known algorithms in the art that the ESS could employ to determine image misregistration and these are fully contemplated as being within the spirit and scope of this disclosure.

Figure 2:
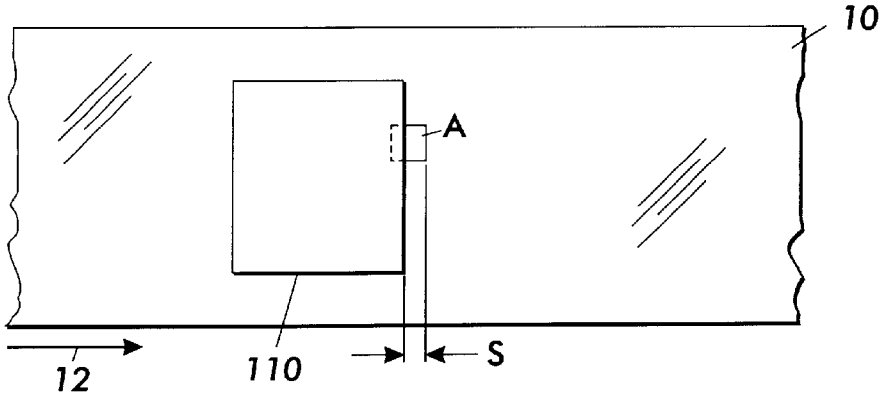
FIG. 2 is a plan view of an embodiment of the instant invention on a portion of a photoreceptor belt used in the FIG. 1 printing machine.
Figure 3:
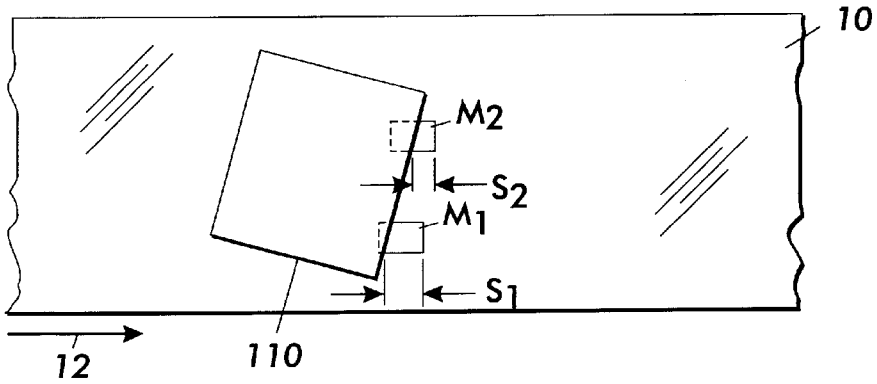
FIG. 3 is a plan view of another embodiment of the instant invention on a photoreceptor belt used in the FIG. 1 printing machine.

Although sheet skew is not present in the embodiment of FIG. 2, it is detectable by a combination of multiple marks. Referring now to FIG. 3, which illustrates another embodiment of the instant invention, the position of sheet 110 is skewed relative to belt 10. In this embodiment, a pair of registration marks M1 and M2 has been developed and partially transferred to sheet 110. The remaining untransferred portions of the marks M1 and M2 are detected by optical density sensors as above and measurements of widths s1 and s2 are made. These measurements are transmitted to the ESS, which compares the measured untransferred toner width value to a known value or series of values, as discussed above, to determine the image to paper skew.

Figure 4:
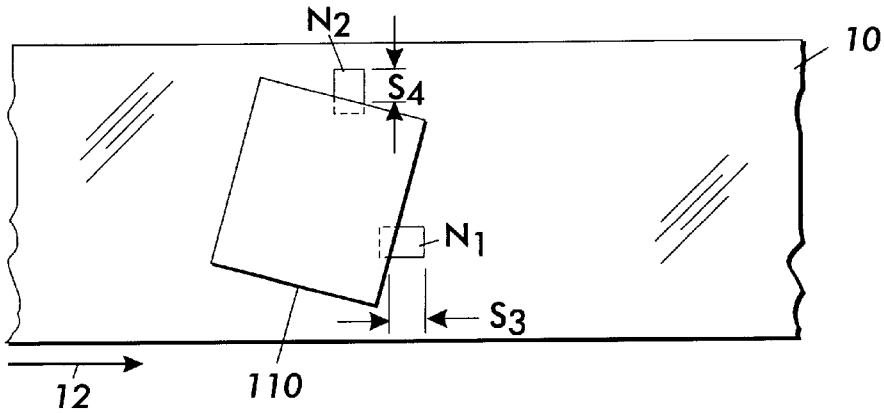
FIG. 4 is a plan view of yet another embodiment of the instant invention on a photoreceptor belt used in the FIG. 1 printing machine.

Alternatively, sheet misregistration may be measured in both the process and lateral (perpendicular to the process) directions as illustrated in FIG. 4, in which one registration mark N1, overlapping the lead edge of the copy sheet, and a second registration mark N2, overlapping the outboard width edge of copy sheet 110, have been developed and partially transferred to sheet 110. The remaining untransferred portions of the marks N1 and N2 are detected by optical density sensors and measurements of the width of s3 and length of s4 are made. As above, these measurements are transmitted to the ESS, which determines the amount of image misregistration in both lateral and process directions. As will be readily apparent to one knowledgeable in the art, marks N1 and N2 could be developed along any combination of two adjacent edges of sheet 110. For example, they could also be developed to overlap the trail edge and inboard width edge of copy sheet 110. As one skilled in the art would recognize, two such registration marks on an end or a side edge of a sheet may be combined with a single registration mark on an adjacent edge to measure skew as well as misregistration. Also, this techniques may be performed simultaneously with other calibration techniques.

This scheme may be used for initial machine setup and/or after replacement of any major subsystem component in the printing machine in lieu of older methods employing original test documents having registration targets thereon.

It is therefore evident that there has been provided, in accordance with the present invention, an apparatus for automatic machine measurement of sheet-to-image registration that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall within the spirit and scope of the appended claims.

What is claimed:

1. A method of registering a moving sheet with an image developed on a surface, comprising:

transferring at least the portion of a developed test area overlapping the sheet edge to the sheet;

sensing the untransferred portion of the test area; and measuring at least one dimension of the untransferred test area to determine the image to sheet registration.

2. The method according to claim 1, further including:

forming a latent image of the test area on the surface; and developing the test area to form the developed test area on the surface.

3. The method according to claim 1, further including:

forming a plurality of space apart test areas; and developing the plurality of test areas to form a plurality of developed test areas.

4. The method according to claim 3, wherein at least one of the developed test areas overlaps one edge of the sheet and at least one of the developed test areas overlaps an adjacent edge of the sheet.

5. The method according to claim 3, wherein a plurality of developed test areas overlap one edge of the sheet and at least one of the developed test areas overlaps an adjacent edge of the sheet.

6. A printing machine of the type in which a moving sheet is registered with an image developed on a surface, wherein the improvement comprises:

a transfer station to transfer at least the portion of a developed test area overlapping the sheet edge to the sheet; and a sensor to sense the untransferred portion of the test area and to measure at least one of the untransferred test areas to determine the image to sheet registration.

7. The printing machine according to claim 6, further comprising:

an imager to form a latent image of the test area on the surface; and a developer to develop the test area to form the developed test area on the surface.

8. The printing machine according to claim 6, further including:

an imager to form a plurality of spaced apart test areas on the surface; and a developer to develop the plurality of test areas to form a plurality of developed test areas.

9. The printing machine according to claim 8, wherein at least one of the developed test areas overlaps one edge of the sheet and at least one of the developed test areas overlaps an adjacent edge of the sheet.

10. The printing machine according to claim 8, wherein a plurality of developed test areas overlaps one edge of the sheet and at least one of the developed test areas overlaps an adjacent edge of the sheet.

* * * * *